US008029312B2

(12) United States Patent
Sagdic et al.

(10) Patent No.: US 8,029,312 B2
(45) Date of Patent: Oct. 4, 2011

(54) PLUG-AND-SOCKET CONNECTOR

(75) Inventors: Mehmet Sagdic, Detmold (DE); Udo Hoppe, Blomberg (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 0 days.

(21) Appl. No.: 12/787,656

(22) Filed: May 26, 2010

(65) Prior Publication Data

US 2010/0304599 A1 Dec. 2, 2010

(30) Foreign Application Priority Data

May 27, 2009 (DE) ..... 102009022798

(51) Int. Cl.
*H01R 13/64* (2006.01)

(52) U.S. Cl. ..... 439/374; 439/540.1

(58) Field of Classification Search ..... 439/374, 439/717, 540.1, 721, 378
See application file for complete search history.

(56) References Cited

U.S. PATENT DOCUMENTS

| | | | | |
|---|---|---|---|---|
| 4,820,169 | A * | 4/1989 | Weber et al. | 439/65 |
| 6,945,810 | B1 * | 9/2005 | Morana et al. | 439/378 |
| 6,997,736 | B2 * | 2/2006 | Costello et al. | 439/378 |
| 2007/0032129 | A1 * | 2/2007 | Kim et al. | 439/540.1 |

* cited by examiner

*Primary Examiner* — Hae Moon Hyeon
(74) *Attorney, Agent, or Firm* — Senniger Powers LLP

(57) ABSTRACT

A plug-and-socket connector with a base strip for a printed circuit board connection and with a male connector having a socket housing projecting on its insertion side having a right-angle cross-sectional base form and opposite longitudinal sides corresponding to this base form and a front side between them. Insertion openings of plug receivers for contact elements are arranged in series in the longitudinal direction of the front side. The plug receivers are parallel extend to the front side and are permanently arranged on the base strip in an alignment corresponding to the insertion openings. A guide element for connecting the base strip to the male connector is provided in a mounted state of the male connector on the base strip between two insertion openings of the male connector and two plug receivers of the base strip corresponding to the two insertion openings.

21 Claims, 7 Drawing Sheets

PLUG-AND-SOCKET CONNECTOR

REFERENCE TO RELATED APPLICATION

This application claims priority to German patent application 10 2009 022 798.9-34 filed May 27, 2009.

FIELD OF THE INVENTION

The invention relates to a plug-and-socket connector for printed circuit board connections.

BACKGROUND OF THE INVENTION

Such plug-and-socket connectors are known in numerous designs and frequently comprise a base strip provided on the one hand for being mechanically fastened on a printed circuit board and on the other hand for establishing the electrical contacting to the printed circuit board. A male connector of the plug-and-socket connector has the problem of electrically connecting incoming and/or outgoing electrical conductors to the base strip and therewith to the structural parts on the printed circuit board. Terminals on or fitting in the male connector are provided for the connection of these conductors.

Furthermore, connecting the male connector to the base strip in such a manner that it is safe against vibrations is known. For this, e.g., a screw coupling is provided and the male connector is correspondingly constructed as a screw plug and the base strip is provided with threaded flanges. The screw connection takes place at the ends of the male connector and of the base strip. In such designs of the plug-and-socket connector the male connector and the base strip can always only be joined together in a single plugging direction. In addition, the screw connection requires a relatively long assembly time. Furthermore, it is difficult, in particular given a great number of plug-in sockets and the contact elements corresponding to them that have to be inserted into the insertion sockets for mounting the base strip on the male connector to center them in such a manner relative to each other that they fit into each other without problems during the assembly.

The invention has the basic problem of making a plug-and-socket connector available in which the mounting of the base strip to the male connector can be simplified.

SUMMARY OF THE INVENTION

The solution of the problem takes place in accordance with the invention by the features of the independent claims. Advantageous embodiments of the invention are indicated in the subclaims.

Briefly, therefore, the invention is directed to a plug-and-socket connector with a base strip for a printed circuit board connection and with a male connector, which male connector has at least one socket housing projecting on its insertion side which socket housing has a right-angle cross-sectional base form and longitudinal sides opposite one another on both sides and corresponding to this base form and has a front side located between them, in which insertion openings of plug receivers for contact elements are arranged in the longitudinal direction of the front side in a successive series, which plug receivers are parallel to each other, extend vertically to the front side and which plug receivers are permanently arranged on the base strip in an alignment corresponding to the insertion openings, and that at least one guide element is provided for connecting the base strip to the male connector, which guide element is provided in a mounted state of the male connector on the base strip between two insertion openings of the male connector and between two plug receivers of the base strip that correspond to the two insertion openings, characterized in that the base strip has at least two base strip elements, and that the guide element is provided in the connection area between the first base strip element and the second base strip element.

In another aspect the invention is directed to a plug-and-socket connector with a base strip for a printed circuit board connection and with a male connector, which male connector has at least one socket housing projecting on its insertion side which socket housing has a right-angle cross-sectional base form and longitudinal sides opposite one another on both sides and corresponding to it and has a front side located between them, in which insertion openings of plug receivers for contact elements are arranged in the longitudinal direction of the front side in a successive series, which plug receivers are parallel to each other, extend vertically to the front side and which plug receivers are permanently arranged on the base strip in an alignment corresponding to the insertion openings, and that at least one guide element is provided for connecting the base strip to the male connector, which guide element is provided in a mounted state of the male connector on the base strip between two insertion openings of the male connector and between two plug receivers of the base strip that correspond to the two insertion openings, characterized in that the male connector has at least two male connector elements, and that the guide element is provided in the connection area between the first male connector element and the second male connector element.

Other objects and features will be in part apparent and in part pointed out hereinafter.

BRIEF DESCRIPTION OF THE FIGURES

The invention is described in detail in the following with reference made to the attached drawings and using preferred embodiments.

DETAILED DESCRIPTION OF PREFERRED EMBODIMENTS

Figure 1:
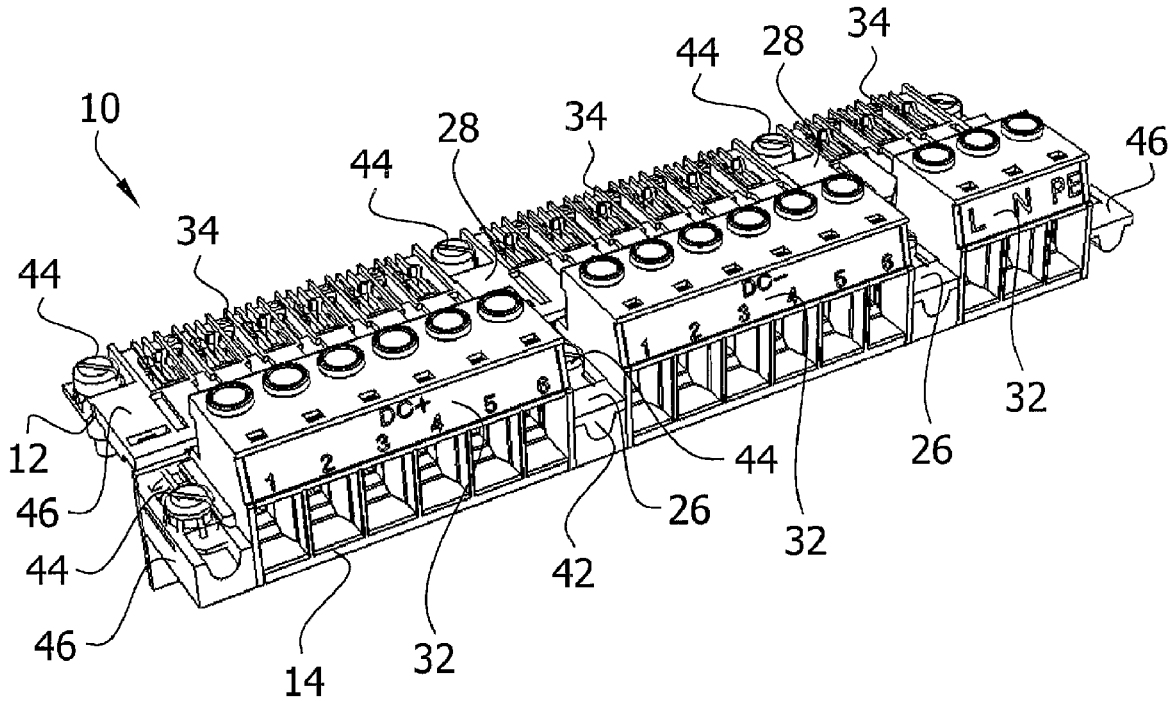
FIG. 1 shows a schematic view of a plug-and-socket connector in accordance with the invention.

This application claims priority to German patent application 10 2009 022 798.9-34 filed May 27, 2009, the entire disclosure of which is incorporated by reference.

Thus, the invention provides a plug-and-socket connector with a base strip for a printed circuit board connection and with a male connector, which male connector has at least one socket housing projecting on its insertion side which socket housing has a right-angle cross-sectional base form and longitudinal sides opposite one another on both sides and corresponding to this base form and has a front side located between them, provides insertion openings of plug receivers for contact elements arranged in the longitudinal direction of the front side in a successive series, which plug receivers are parallel to each other, extend vertically to the front side and which plug receivers are permanently arranged on the base strip in an alignment corresponding to the insertion openings, and that at least one guide element is provided for connecting the base strip to the male connector, which guide element is provided in a mounted state of the male connector on the base strip between two insertion openings of the male connector and between two plug receivers of the base strip that correspond to the two insertion openings, which base strip has at least two base strip elements, and that the guide element is provided in the connection area between the first base strip element and the second base strip element.

Furthermore, the invention provides a plug-and-socket connector with a base strip for a printed circuit board connection and with a male connector, which male connector has at least one socket housing projecting on its insertion side which socket housing has a right-angle cross-sectional base form and longitudinal sides opposite one another on both sides and corresponding to it and has a front side located between them, provides insertion openings of plug receivers for contact elements arranged in the longitudinal direction of the front side in a successive series, which plug receivers are parallel to each other, extend vertically to the front side and which plug receivers are permanently arranged on the base strip in an alignment corresponding to the insertion openings, and that at least one guide element is provided for connecting the base strip to the male connector, which guide element is provided in the mounted state of the male connector on the base strip between two insertion openings of the male connector and between two plug receivers of the base strip that correspond to the two insertion openings, which male connector has at least two male connector elements, and that the guide element is provided in the connection area between the first male connector element and the second male connector element.

A significant aspect of the invention thus resides in the fact that the guide element is provided in the connection area between the first male connector element and the second male connector element and between the first base strip element and the second base strip element. This means that the guide element is therefore arranged in such an area in which the individual base strip elements and male connector elements are connected to each other. Basically, the guide elements can establish the connection themselves here, which is not, however, obligatorily necessary; the connection can therefore also be established in that the base strip element and male connector elements themselves have devices for connecting them to each other.

The guide element is preferably designed as a guide bolt or as a guide pin that extends from the base strip to the male connector or inversely. Preferably, more than one guide element are provided that are each provided between two insertion openings of the male connector and between two plug receivers of the base strip that correspond to the two insertion openings. The corresponding plug receivers are the plug receivers that are introduced into the corresponding insertion openings. However, the guide elements can also be provided on the two ends of the longitudinal sides of the base strip and of the male connector. As a result of the fact that at least one guide element is provided that is provided in a mounted state of the male connector on the base strip between two insertion openings of the male connector and between two plug receivers of the base strip corresponding to the two insertion openings, the base strip can be securely and simply centered to the male connector, so that the plug receivers can be simply and rapidly introduced into the particular insertion openings, so that the mounting expense of the base strip to the male connector can be reduced by a significant amount.

It is preferably provided that the guide element is arranged in the mounted state inside of a structural component element provided on the base strip and inside of a structural component element provided on the male connector. As a result, the guide element is preferably no longer visible in the mounted state from the outside and the guide element is guided inside the structural component element.

According to a preferred embodiment of the invention the at least one guide element is fastened inside the structural component element provided on the base strip and extends from the base strip into an opening provided on the structural component element provided on the male connector. During the mounting of the male connector on the base strip the opening provided on the structural component element of the male connector is pushed onto the guide element.

Alternatively, according to another preferred embodiment of the invention the guide element is fastened inside the structural component element provided on the male connector and extends from the male connector into an opening provided on the structural component element provided on the base strip. During the mounting of the base strip on the male connector the opening provided on the structural component element of the base strip is pushed onto the guide element.

Furthermore, it is preferably provided that the structural component element is joined together from at least two partial elements so that in order to connect the first base strip element to the second base strip element and/or to connect the first male connector element to the second male connector element a first partial element of the first base strip element can be connected to a second partial element of the second base strip element and/or a first partial element of the first male connector element can be connected to a second partial element of the second male connector element.

The structural component element is preferably provided in the plugged-together state of the two base strip elements between an insertion opening of the first base strip element and an insertion opening of the second base strip element and/or arranged in the plugged-together state of the two male connector elements between a contact element of the first male connector element and a contact element of the second male connector element, which structural component element has a rectangular form preferably along its circumferential surface. Due to the fact that the structural component element is composed of at least two partial elements the structural component element can be used in such a manner that any desired number of base strip elements or any desired number of male connector elements can be aligned on each other. To this end preferably one of the base strip elements has a partial element and the base strip element to be joined to the first base strip element comprises the second partial element that fits it, so that during the joining together of the first base strip element to the second base strip element the structural component element is formed from the two partial elements. The same applies to two male connector elements to be connected.

According to an advantageous embodiment of the invention the connecting of the first partial element to the second partial element can be realized by a movement of the first base strip element vertically to the longitudinal side of the second base strip element and/or the connecting of the first partial element to the second partial element can be realized by a movement of the first male connector element vertically to the longitudinal side of the second male connector element.

Alternatively, it is preferably provided that the connecting of the first partial element to the second partial element can be realized by a movement of the first base strip element horizontally to the longitudinal side of the second base strip element and/or the connecting of the first partial element to the second partial element can be realized by a movement of the first male connector element horizontally to the longitudinal side of the second male connector element.

In order to fasten the base strip and the male connector on a printed circuit board and/or an appropriate device interface, a further advantageous embodiment of the invention provides fastening elements of which at least one fastening element is provided between two insertion openings of the male connector and at least one fastening element is provided between two plug receivers of the base strip. The fastening elements are preferably fastened via flanges on the printed circuit board and/or on an appropriate device interface, which flanges are provided on the base strip and the male connector. The fastening elements are preferably designed as screw connections.

The fastening element is preferably provided in the area of the guide element. The structural component elements in which the guide element is arranged can already be designed as a flange so that additional flanges are no longer necessary for this and a fastening element can be fastened directly via the structural component elements to the printed circuit board and/or to an appropriate device interface.

It is furthermore provided that the base strip and the male connector have at least one fastening element on their ends formed in the longitudinal direction.

FIG. 1 shows a plug-and-socket connector 10 in accordance with the invention that comprises a base strip 12 and a male connector 14.

Figure 2:
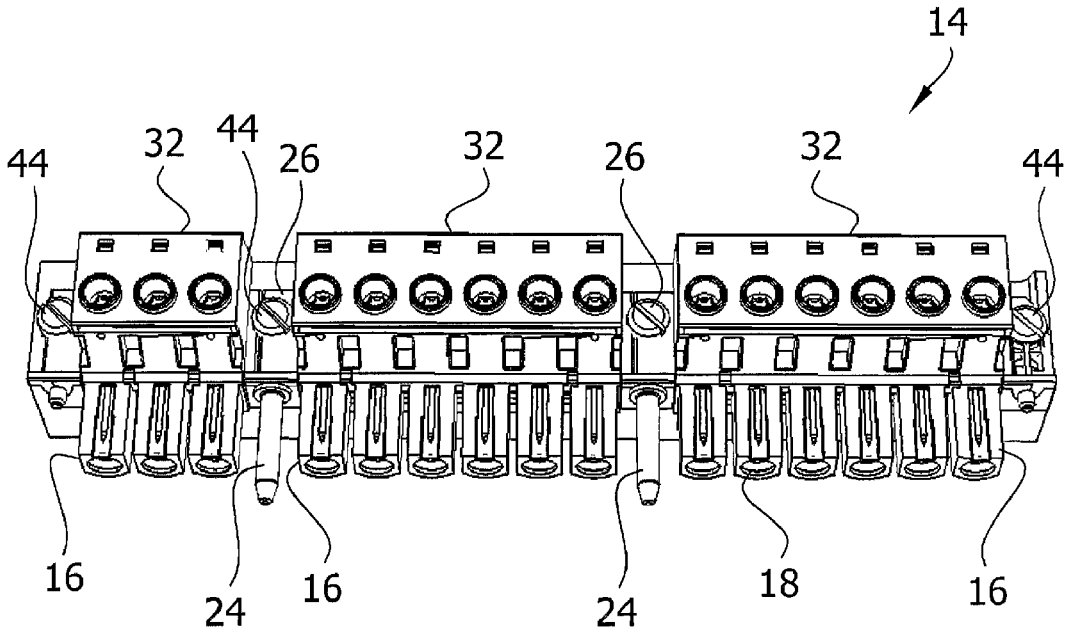
FIG. 2 shows a schematic view of a male connector of the plug-and-socket connector shown in FIG. 1.
Figure 6:
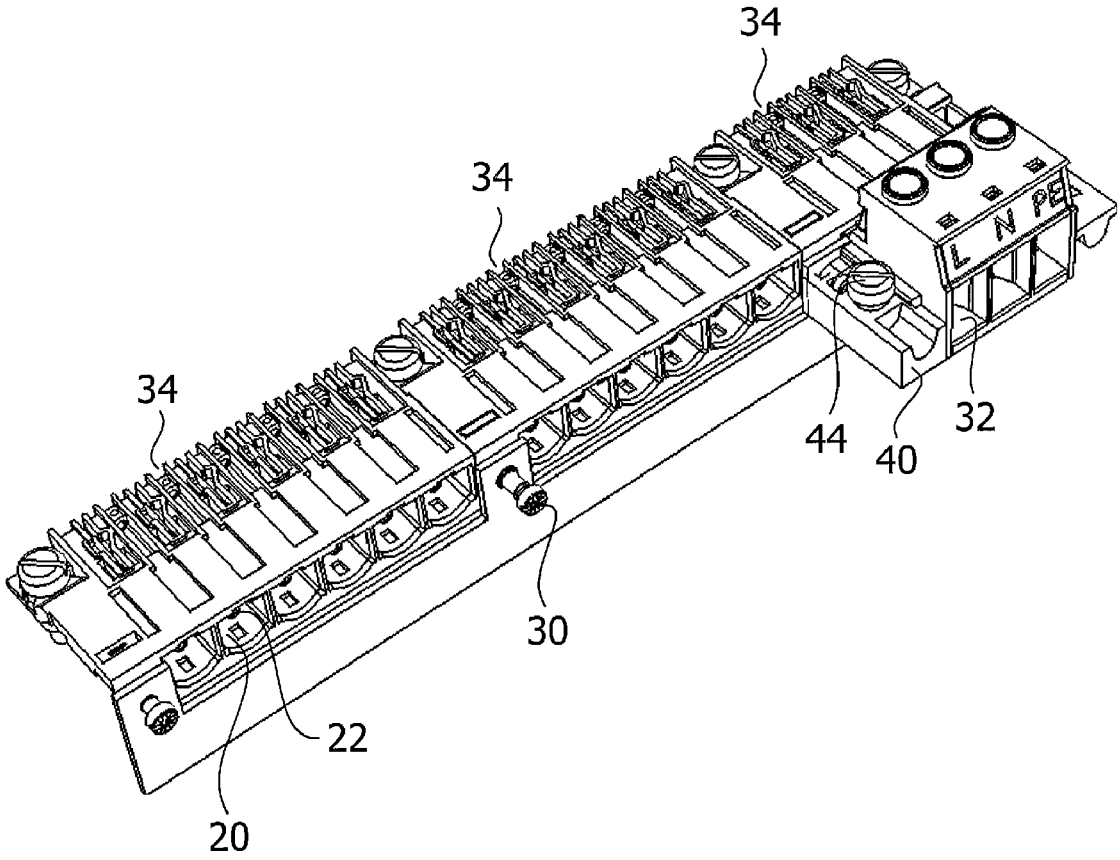
FIG. 6 shows a schematic view of the plug-and-socket connector shown in FIG. 1 with only one male connector element.

Male connector 14 shown in FIG. 1 is also shown in FIG. 2. Male connector 14 has three socket housings 16 projecting from its insertion side. Each housing 16 has a right-angle cross-sectional base form and opposite sides extending longitudinally to a front side of the male connector. A series of insertion openings 18 of plug receivers 20 for contact elements 22 (FIG. 6) are arranged so the plug receivers extend parallel to each other to a front side of base strip 12 in an alignment corresponding to the insertion openings 18. Two guide elements 24 are provided to connect base strip 12 to male connector 14. Two guide elements 24 are provided to mount the male connector 14 on the base strip 12 between two insertion openings 18 of the male connector and between two plug receivers 20 of base strip 12. The plug connectors correspond to the two insertion openings 18.

Figure 3:
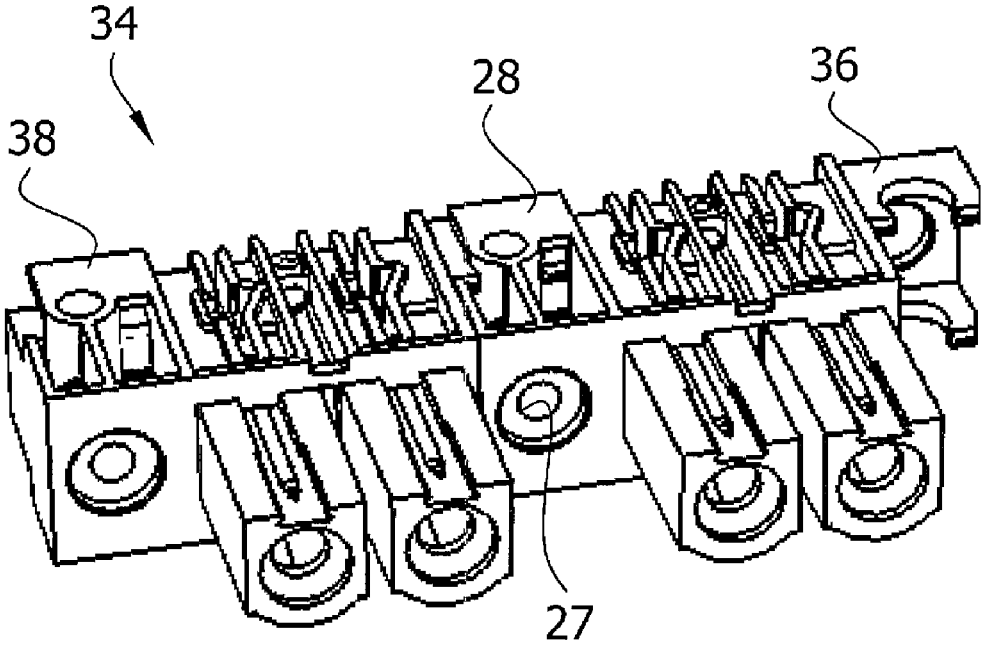
FIG. 3 shows a schematic view of a base strip element according to a first embodiment.

Guide elements 24 are arranged in the mounted state inside a structural component element 28 provided on base strip 12 and inside a structural component element 26 provided on male connector 14. Guide elements 24 can be fastened inside structural component element 26 provided on male connector 14 and can extend from male connector 14 into an opening 27 (FIG. 3) provided on structural component element 28 on base strip 12. When base strip 12 is mounted on male connector 14 the opening 27 provided on structural component element 28 of base strip 12 is pushed onto guide element 24.

Base strip 12 is built up in the embodiment shown from three base strip elements 34 and male connector 14 is built up from three male connector elements 32 and guide elements 24 are provided here in the connection area between the individual base strip elements 34 and in the connection area between the individual male connector elements 32. This means that guide elements 24 are arranged in the areas in which the individual base strip elements 34 and male connector elements 32 are connected to each other. Basically, guide elements 24 can establish the connection here but this is not obligatorily necessary; the connection can also be established in that the base strip elements 34 and male connector elements 32 have devices themselves for connecting them to each other.

Figure 4:
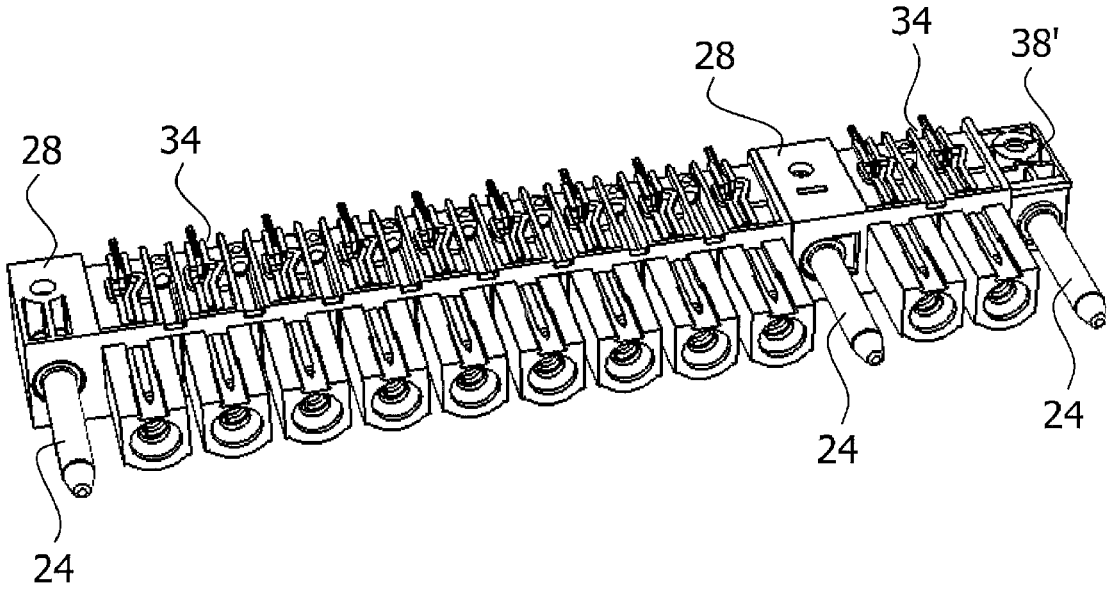
FIG. 4 shows a first schematic view of a base strip element according to a second embodiment.
Figure 5:
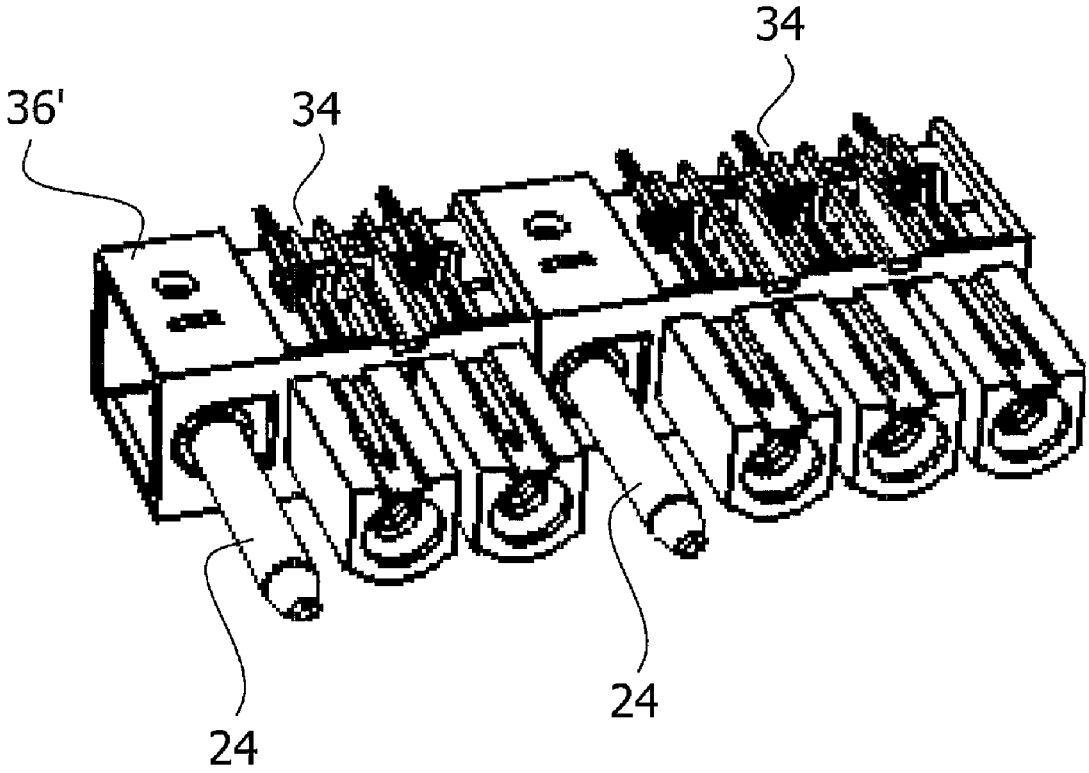
FIG. 5 shows a second schematic view of a base strip element according to the second embodiment.

For connecting base strip elements 34 and for connecting male connector elements 32 the structural component elements 26, 28 are built up from two partial elements 36, 38, 36', 38', 40, 42, which partial elements 36, 38, 36', 38', 40, 42 preferably have locking elements so that the particular partial elements that belong together can be locked into each other. Partial elements 36, 38 shown in FIG. 3 can be realized by a movement of a first base strip element 34 vertically to the longitudinal side of a second base strip element 34 of which only one base strip element 34 is now shown here. Partial elements 36', 38' shown in FIGS. 4 and 5 can be connected to one another in such a manner that partial element 38' is pushed horizontally to the longitudinal side of base strip 12 into partial element 36' of another base strip 12.

In order to fasten base strip 12 and male connector 14 on a printed circuit board and/or an appropriate device interface (not shown here), fastening elements 44 in the form of screws are provided, which fastening elements 44 are provided in particular between two insertion openings 18 of the male connector part and between two plug receivers 20 of base strip 12. Fastening elements 44 are provided here in the area of guide elements 24. Structural component elements 26, 28, in which guide elements 24 are arranged, can already function as a flange so that additional flanges are no longer necessary for this. Furthermore, fastening elements 44 can be fastened via flanges 46, additionally provided on base strip 12 and male connector 14, on the printed circuit board and/or an appropriate device interface, which flanges 46 are provided on the ends of base strip 12 and of male connector 14, which ends are constructed in the longitudinal direction.

Figure 7:
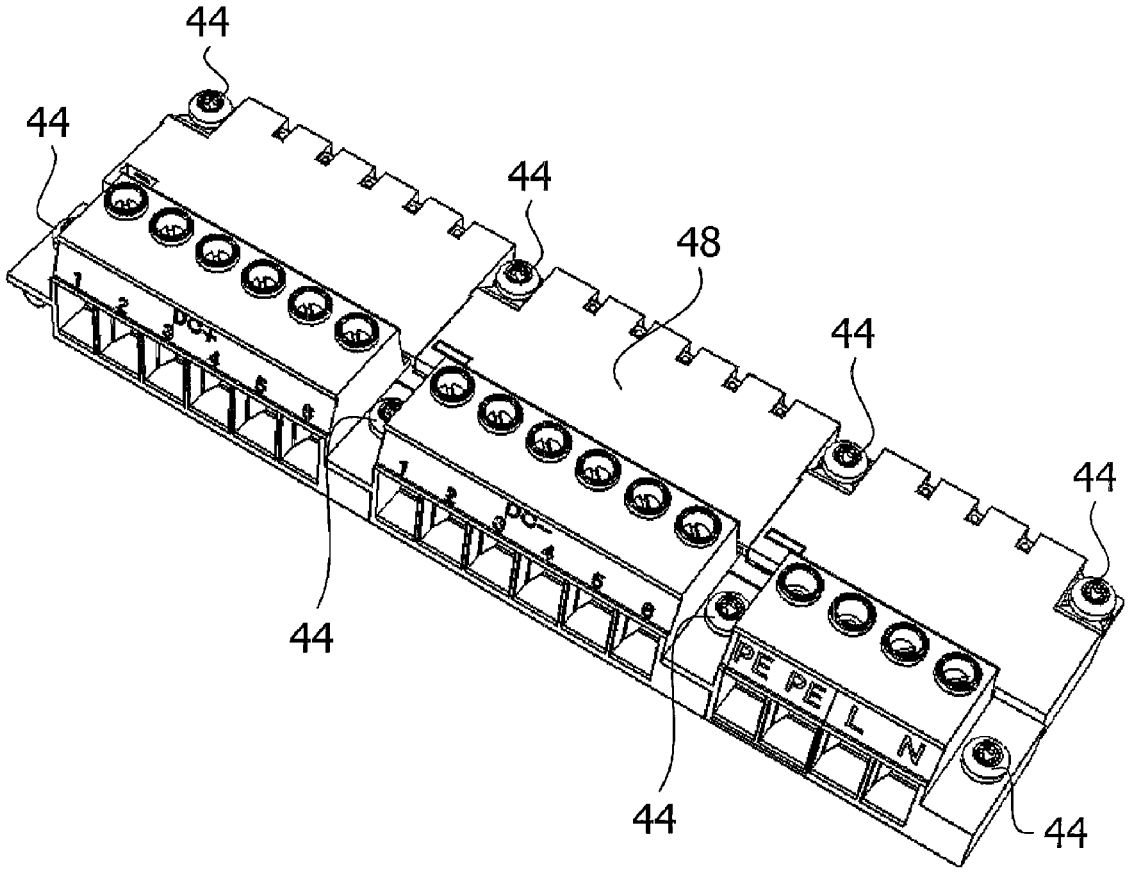
FIG. 7 shows a schematic view of the plug-and-socket connector shown in FIG. 1 in a housing.

In FIG. 7 plug-and-socket connector 10 shown in FIG. 1 is arranged in a housing 48.

LIST OF REFERENCE NUMERALS

| | |
|---|---|
| plug-and-socket connector | 10 |
| base strip | 12 |
| male connector | 14 |
| socket housing | 16 |
| insertion opening | 18 |
| plug receiver | 20 |
| contact element | 22 |
| guide element | 24 |
| structural component element | 26 |
| structural component element | 28 |
| screw connection | 30 |
| male connector element | 32 |
| base strip element | 34 |
| partial element | 36 |
| partial element | 38 |
| partial element | 36' |
| partial element | 38' |
| partial element | 40 |
| partial element | 42 |
| fastening element | 44 |
| flange | 46 |
| housing | 48 |

When introducing elements of the present invention or the preferred embodiments(s) thereof, the articles “a”, “an”, “the” and “said” are intended to mean that there are one or more of the elements. The terms “comprising”, “including”

and "having" are intended to be inclusive and mean that there may be additional elements other than the listed elements.

As various changes could be made in the above compositions and methods without departing from the scope of the invention, it is intended that all matter contained in the above description and shown in the accompanying drawings shall be interpreted as illustrative and not in a limiting sense.

The invention claimed is:

1. A plug-and-socket connector with a base strip for a printed circuit board connection comprising:

a male connector, at least one socket housing of the male connector projecting from an insertion side having a right-angle cross-sectional base form and opposite sides corresponding to the base form and extending longitudinally to a front side, a series of insertion openings of plug receivers for contact elements arranged so the plug receivers are parallel to each other, extend to the front side and are permanently arranged on the base strip in alignment with the insertion openings, at least one guide element for connecting the base strip to the male connector, the guide element being positioned between two insertion openings of the male connector and between two plug receivers of the base strip corresponding to the two insertion openings when the male connector is mounted on the base strip, and with the guide element arranged in a connection area between elements selected from the group consisting of a) a first base strip element and a second base strip element, and b) a first male connector element and a second male connector element.

2. The plug-and-socket connector of claim 1 wherein the guide element is arranged in the connection area between the first base strip element and the second base strip element.

3. The plug-and-socket connector of claim 1 wherein the guide element is arranged in the connection area between the first male connector element and the second male connector element.

4. The plug-and-socket connector according to claim 2, wherein the guide element is arranged in the mounted state inside a structural component element provided on the base strip and inside a structural component element provided on the male connector.

5. The plug-and-socket connector according to claim 4, wherein the guide element is fastened inside the structural component element provided on the base strip and extends from the base strip into an opening provided on the structural component element provided on the base strip element.

6. The plug-and-socket connector according to claim 4, wherein the guide element is fastened inside the structural component element provided on the male connector and extends from the male connector into an opening provided on the structural component element provided on the base strip.

7. The plug-and-socket connector according to claim 4, wherein the structural component element is joined together from at least two partial elements so that in order to connect the first base strip element to the second base strip element) and/or to connect the first male connector element to the second male connector element a first partial element of the first base strip element can be connected to a second partial element of the second base strip element and/or a first partial element of the first male connector element can be connected to a second partial element of the second male connector element.

8. The plug-and-socket connector according to claim 7, wherein the first partial element can be connected to the second partial element by moving the first base strip element vertically to the longitudinal side of the second base strip element and/or the first partial element can be connected to the second partial element by moving the first male connector element vertically to the longitudinal side of the second male connector element.

9. The plug-and-socket connector according to claim 7, wherein the first partial element can be connected to the second partial element by moving the first base strip element horizontally to the longitudinal side of the second base strip element and/or the first partial element can be connected to the second partial element by moving the first male connector element horizontally to the longitudinal side of the second male connector element.

10. The plug-and-socket connector according to claim 2, wherein in order to fasten the base strip and the male connector on the printed circuit board and/or on an appropriate device interface, fastening elements are provided, of which at least one fastening element is provided between two insertion openings of the male connector and at least one fastening element is provided between two plug receivers of the base strip.

11. The plug-and-socket connector according to claim 10, wherein the at least one fastening element is provided in the area of the at least one guide element.

12. The plug-and-socket connector according to claim 10, wherein the base strip and the male connector have at least one fastening element on their ends, which ends are constructed in longitudinal directions.

13. The plug-and-socket connector according to claim 3, wherein the guide element is arranged in the mounted state inside a structural component element provided on the base strip and inside a structural component element provided on the male connector.

14. The plug-and-socket connector according to claim 13, wherein the guide element is fastened inside the structural component element provided on the base strip and extends from the base strip into an opening provided on the structural component element provided on the male connector.

15. The plug-and-socket connector according to claim 13, wherein the guide element is fastened inside the structural component element provided on the male connector and extends from the male connector into an opening provided on the structural component element provided on the base strip.

16. The plug-and-socket connector according to claim 13, wherein the structural component element is joined together from at least two partial elements so that in order to connect the first base strip element to the second base strip element and/or to connect the first male connector element to the second male connector element a first partial element of the first base strip element can be connected to a second partial element of the second base strip element and/or a first partial element of the first male connector element can be connected to a second partial element of the second male connector element.

17. The plug-and-socket connector according to claim 16, wherein the first partial element can be connected to the second partial element by moving the first base strip element vertically to the longitudinal side of the second base strip element and/or the first partial element can be connected to the second partial element by moving the first male connector element vertically to the longitudinal side of the second male connector element.

18. The plug-and-socket connector according to claim 16, wherein the first partial element can be connected to the second partial element by moving the first base strip element horizontally to the longitudinal side of the second base strip element and/or the first partial element can be connected to the second partial element by moving the first male connector element horizontally to the longitudinal side of the second male connector element.

19. The plug-and-socket connector according to claim 3, wherein in order to fasten the base strip and the male connector on a printed circuit board and/or on an appropriate device interface, fastening elements are provided, of which at least one fastening element is provided between two insertion openings of the male connector and at least one fastening element is provided between two plug receivers of the base strip.

20. The plug-and-socket connector according to claim 19, wherein the at least one fastening element is provided in the area of the at least one guide element.

21. The plug-and-socket connector according to claim 19, wherein the base strip and the male connector have at least one fastening element on their ends, which ends are constructed in longitudinal directions.

* * * * *